United States Patent [19]

Williams

[11] Patent Number: 4,463,742

[45] Date of Patent: Aug. 7, 1984

[54] FUEL ENCONOMIZER

[76] Inventor: Cyril J. Williams, 23 Borrow St., Freeling, Australia, 5372

[21] Appl. No.: 420,905

[22] Filed: Sep. 21, 1982

[51] Int. Cl.[3] ..... F02M 29/00

[52] U.S. Cl. ..... 123/590; 123/180 R; 48/189

[58] Field of Search ..... 123/590, 180 M; 261/79 R; 48/189.4, 180.1

[56] References Cited

U.S. PATENT DOCUMENTS

| | | | |
|---|---|---|---|
| 1,584,046 | 5/1926 | Smith | 48/189.4 |
| 1,697,528 | 1/1929 | Kahn | 48/189.4 |
| 1,778,790 | 10/1930 | Brandl et al. | 48/189.4 |
| 2,028,937 | 1/1936 | LeFebre | 48/189.4 |
| 2,745,394 | 5/1956 | Holley, Sr. | 123/590 |
| 3,393,984 | 7/1968 | Wisman | 123/590 |
| 3,938,967 | 2/1976 | Reissmüller | 123/590 |
| 4,333,441 | 6/1982 | Still et al. | 125/590 |

FOREIGN PATENT DOCUMENTS

| | | | |
|---|---|---|---|
| 451559 | 10/1927 | Fed. Rep. of Germany | 123/590 |
| 969497 | 12/1950 | France | 123/59 |
| 2259246 | 8/1975 | France | 48/189.4 |
| 2059504 | 4/1981 | United Kingdom | 48/180 M |

*Primary Examiner*—Ethel R. Cross

*Attorney, Agent, or Firm*—Pearne, Gordon, Sessions, McCoy, Granger & Tilberry

[57] ABSTRACT

A fuel economizer for fitting between the carburetor and inlet manifold of an internal combustion engine. The economizer consists of a plate having a restricted orifice, there being situated beneath the orifice a further plate having a plurality of teeth or protrusions extending into the fuel/air stream passing through the restricted orifice.

13 Claims, 3 Drawing Figures

FUEL ENCONOMIZER

This invention relates to an improved fuel economiser, and more particularly to improvements in economisers for increasing the economy of internal combustion engines.

In an earlier patent specification of mine there is described a fuel economiser in which the economiser includes a restricted orifice to be positioned downstream of the conventional carburetor, this restricted orifice having a bell mouth or trumpet shape with the internal surface of this shape being provided with dimples or protrusions to assist in the atomization and vaporization of the fuel droplets flowing therethrough with the air-stream.

These economisers are quite satisfactory and give an increase in the economy of the internal combustion engine.

However, it has been found that improvements can be made to these units, and improvements resulting in a more uniform economy being obtained.

Thus there is provided according to the invention a fuel economiser adapted to be inserted in the induction system of an internal combustion engine downstream of the carburetor thereof, said economiser comprising a plate having an aperture less than the diameter of the induction passage and a disc adjacent to and downstream of said plate and having a plurality of teeth protruding into the air stream adjacent said plate.

Figure 1:
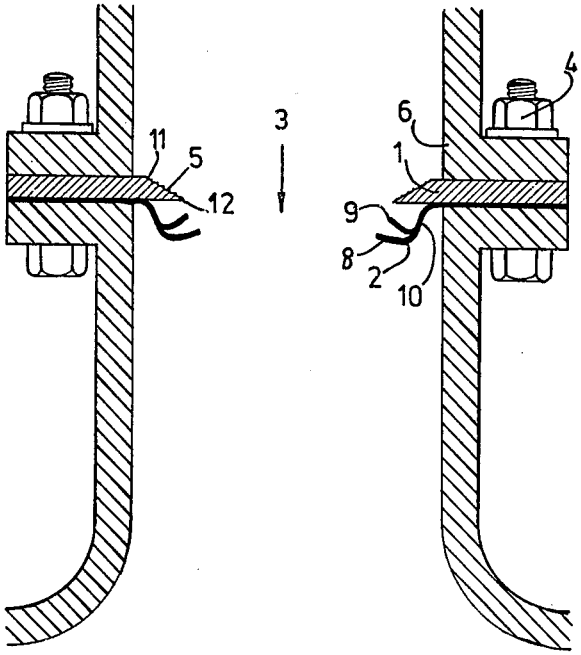
Figure 2:
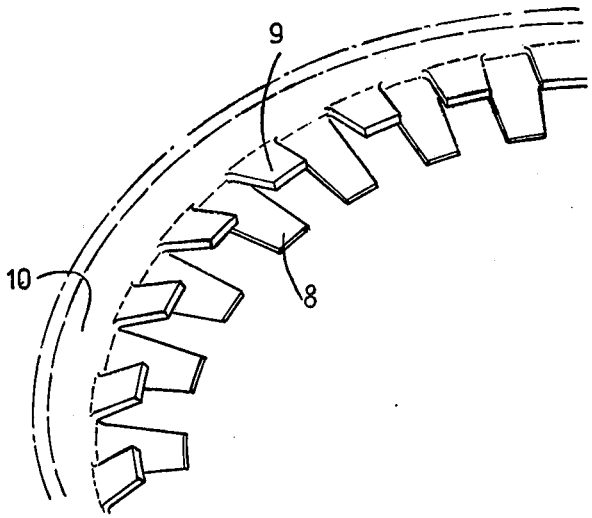
Figure 2A:
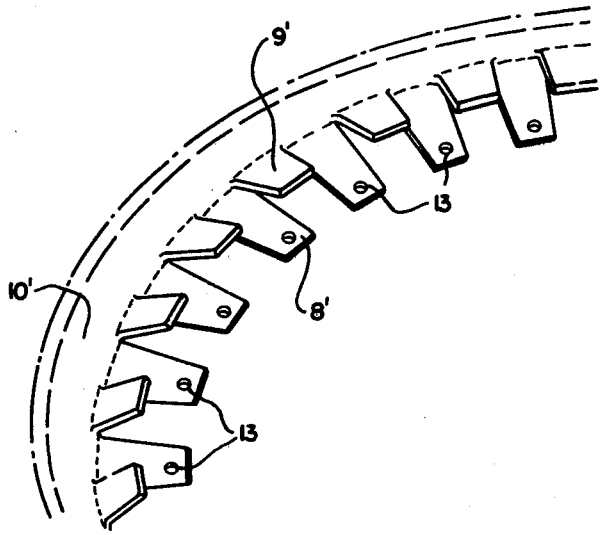

In order to more fully describe the invention reference will now be made to the accompanying drawings in which:

FIG. 1 is a cross-section of the invention fitted between the carburetor and the manifold, FIG. 2 is a view of a portion of the lower disc and FIG. 3 is a view similar FIG. 2 showing another embodiment.

Referring to the drawings the invention comprises an upper plate 1 and a lower disc 2. The plate 1 preferably is cast metal and has a central aperture 3 and end holes for mounting bolts 4.

The aperture 3 in the plate is formed by a bevel surface 5, the large diameter being at or about the diameter of an induction passage generally indicated at 6. The bevel surface 5 is preferably formed at 30° to the horizontal, but could vary between 20° and 60°, this variation being discussed in detail later.

The lower disc 2 is stamped from metal and also has end holes for the mounting box 4. This disc 2 is provided with a central aperture defined by a plurality of protruding teeth or lugs 8, 9. The teeth 8, 9 extend geneerally inwardly from the lower end of a sloping annular wall 10. The wall 10 is formed by pressing or stamping and extends generally away from the plane of the disc 2 in the direction of flow through the unit, that is away from the upper plate 1. The teeth are formed in two rows by stamping from the plate, the lower row 8 being generally parallel to the plane of the disc 2, while the upper row 9 are inclined upwardly at an angle of between 10° and 30°. Preferably this angle is in the order of 20°.

The bevelled surface 5 of the upper plate is provided with small depressions and protrusions 11 to provide a roughened surface, and a lip 12 forming the aperture 3 is provided with small serrations.

The diameter of the aperture 3 formed by the lip 12 has been found to bear a relationship with the diameter of the induction passage 6, and it has been found that the preferred relationship is that the aperture diameter at the lip 12 should be 2 to 2.5 mm less than the induction passage diameter. Satisfactory results are also obtained if the lip diameter is between 1.5 mm and 3.5 mm less than the induction passage diameter, but the preferred distance is 2.37 mm less than the induction passage diameter.

Hence in order for the lip diameter to bear this relationship with the induction passage diameter, then as the bevel surface begins at or about the wall of the boss of the carburetor, then the angle of the bevel surface will vary between 20° and 60°, thus accommodating for the relationship between the aperture diameter and the diameter of the induction passage as provided at the internal wall of the boss of the carburetor.

The top row of teeth 9 are generally of the same diameter as the lip diameter 12, but the lower row of teeth 8 extend further inwardly and are generally 3 to 4 mm less in diameter than the diameter of the lip 12.

The exact reason for the operation of the unit is not clear but it has been well established that by fitting the unit to a motor vehicle that not only is the economy achieved, but also that the motor will perform with greater power.

It has been found that contrary to expectations that the fitting of the unit does not produce a starving effect or obstruct the flow through the induction system, and that it is felt that by the use of the unit the petrol droplets are atomized to be of less than 10 microns in diameter. At this diameter the fuel droplets do not adhere to the wall of the induction system and are thus finally and uniformally distributed throughout the induction system and thus further ensures that all cylinders receive similar air flows and also similar mixtures.

It has also been found that with the unit fitted that there is a slight increase in manifold pressure this then also assisting the flow through the induction system.

In a further embodiment of the invention the teeth 8′ and 9′, or more particularly only the teeth 8′ can be provided with a plurality of small holes 13 formed therethrough as shown in FIG. 3. These can be drilled or punched through the teeth and apparently due to the fact that there is the reduced air pressure downstream of the disc and plate, that any liquid which tends to collect on the upper surface of the plate will thus tend to be drawn through these apertures and thus would be atomized as the air flow through the apertures passes into the area of reduced pressure.

It will be seen that the rows of teeth are staggered in relation to each other, the teeth being formed by punching and then the upper row bent upwardly as shown.

It has been felt that the air flow passed the teeth and tongue forces a swirling effect which will effectively break up any droplets of fuel which may tend to collect on the tongues or teeth, so that greater atomization of the fuel does take place.

Although various forms of the invention have been described it is to be realised that the invention is not to be limited thereto but can include various modifications falling within the spirit and scope of the invention.

The claims defining the invention are as follows:

1. A fuel economiser adapted to be inserted in the induction system of an internal combustion engine downstream of the carburetor thereof, said induction system including an induction passage for flow of an air stream through the system, said economiser comprising a plate including an aperture having a diameter less than the diameter of the induction passage, and a disc adjacent to and downstream of said plate and having a plurality of teeth protruding into the induction passage and air stream adjacent said plate.

2. A fuel economiser as defined in claim 1 wherein said plate has a bevelled upper surface, and said disc has a plurality of rows of staggered teeth.

3. A fuel economiser as defined in claim 2 wherein said disc is formed with the teeth protruding from a portion parallel to an spaced from the plane of the disc, said rows of teeth comprising two rows, an upper row and a lower row.

4. A fuel economiser as defined in claim 3 wherein said lower row extends into the air stream beneath said aperture in said plate.

5. A fuel economiser as defined in claim 1 wherein the diameter of the aperture in the plate is between 2 and 2.5 mm less than the diameter of the induction passage.

6. A fuel economiser as defined in claim 4 wherein the diameter of the lower row of teeth is 3 mm less than the diameter of the lip of the aperture in the plate.

7. A fuel economiser as defined in claim 3 wherein at least some of the teeth on the disc are formed with holes therethrough.

8. A fuel economiser as defined in claim 1, wherein said teeth are located primarily radially outward of said aperture.

9. A fuel economiser as set forth in claim 8, wherein said teeth extend radially into said aperture a distance equal to from 1.5 mm to 2.0 mm.

10. A fuel economiser as defined in claim 9, wherein the diameter of the aperture in the plate is between 2.0 mm and 2.5 mm less than the diameter of the induction passage.

11. A fuel economiser adapted to be inserted in the induction system of an internal combustion engine downstream of the carburetor thereof, said induction system including an induction passage for flow of an air stream through the system, said economiser comprising a plate and a disc arranged to be peripherally mounted in said induction passage, said disc being mounted adjacent to and downstream of said plate, said plate including a beveled surface extending into the induction passage and tapering in the downstream direction to an aperture, said aperture extending through said plate and having a diameter less than the diameter of the induction passage, said disc including an annular portion extending to provide a plurality of rows of axially spaced teeth, said annular portion of said disc extending in a downstream direction, one of said rows of teeth extending in a substantially radially inward direction and another of said rows of teeth extending in an upstream direction.

12. A fuel economiser as defined in claim 11, wherein said teeth are located primarily radially outward of said aperture.

13. A fuel economiser as defined in claim 12, wherein said beveled surface includes surface depressions and protrusions to provide a roughened surface.

* * * * *